US007392575B2

(12) United States Patent
Noelle

(10) Patent No.: US 7,392,575 B2
(45) Date of Patent: Jul. 1, 2008

(54) METHOD AND MACHINE FOR PRODUCING A NONWOVEN FABRIC WITH REDUCTION OF DISPLACEMENT SPEED OF THE COMPACTED MAT

(75) Inventor: Frédéric Noelle, Saint Nazaire les Eymes (FR)

(73) Assignee: Rieter Perfojet, Montbonnot (FR)

( * ) Notice: Subject to any disclaimer, the term of this patent is extended or adjusted under 35 U.S.C. 154(b) by 545 days.

(21) Appl. No.: 10/529,844

(22) PCT Filed: Oct. 7, 2003

(86) PCT No.: PCT/FR03/02940

§ 371 (c)(1),
(2), (4) Date: Mar. 31, 2005

(87) PCT Pub. No.: WO2004/033781

PCT Pub. Date: Apr. 22, 2004

(65) Prior Publication Data

US 2006/0080816 A1 Apr. 20, 2006

(30) Foreign Application Priority Data

Oct. 11, 2002 (FR) ..... 02 12652

(51) Int. Cl.
*D04H 1/48* (2006.01)
*D04H 3/10* (2006.01)

(52) U.S. Cl. ..... 28/116; 28/104; 28/112; 28/122; 28/18.6

(58) Field of Classification Search ..... 28/104, 28/105, 107, 112, 108–111, 113, 114, 115, 28/116, 122, 134, 138, 167, 103, 117, 135, 28/136, 165, 139; 26/18.6, 18.5; 156/148, 156/166, 181, 580; 264/283, 294
See application file for complete search history.

(56) References Cited

U.S. PATENT DOCUMENTS

| | | | | |
|---|---|---|---|---|
| 3,829,939 | A * | 8/1974 | Dilo | 28/107 |
| 3,837,054 | A * | 9/1974 | Fehrer | 28/107 |
| 5,268,015 | A | 12/1993 | Furtak et al. | |
| 5,671,518 | A | 9/1997 | Kummermehr et al. | |
| 5,718,022 | A * | 2/1998 | Vuillaume | 28/105 |
| 5,881,440 | A * | 3/1999 | Deeming et al. | 28/104 |
| 5,909,883 | A * | 6/1999 | Jourde et al. | 28/114 |
| 5,960,525 | A * | 10/1999 | Fleissner | 28/104 |
| 6,195,845 | B1 | 3/2001 | DuPont et al. | |
| 6,385,825 | B1 * | 5/2002 | Wang et al. | 28/107 |
| 6,412,155 | B2 * | 7/2002 | Fleissner | 28/104 |
| 6,634,069 | B2 * | 10/2003 | Dilo et al. | 28/107 |
| 6,750,166 | B1 * | 6/2004 | Etzold et al. | 442/329 |

(Continued)

FOREIGN PATENT DOCUMENTS

| | | |
|---|---|---|
| EP | 0 365 826 | 5/1990 |

(Continued)

*Primary Examiner*—Amy B Vanatta
(74) *Attorney, Agent, or Firm*—Pearne & Gordon LLP

(57) ABSTRACT

The invention concerns a machine for producing a nonwoven fabric comprising a conveyor for transmitting a mat to means designed to compact same in thickness and means designed to reduce the speed of the web while it is being compacted, by the compacting means, thereby obtaining an enhanced ratio of properties lengthwise relative to crosswise properties.

14 Claims, 4 Drawing Sheets

U.S. PATENT DOCUMENTS

Figure 1:
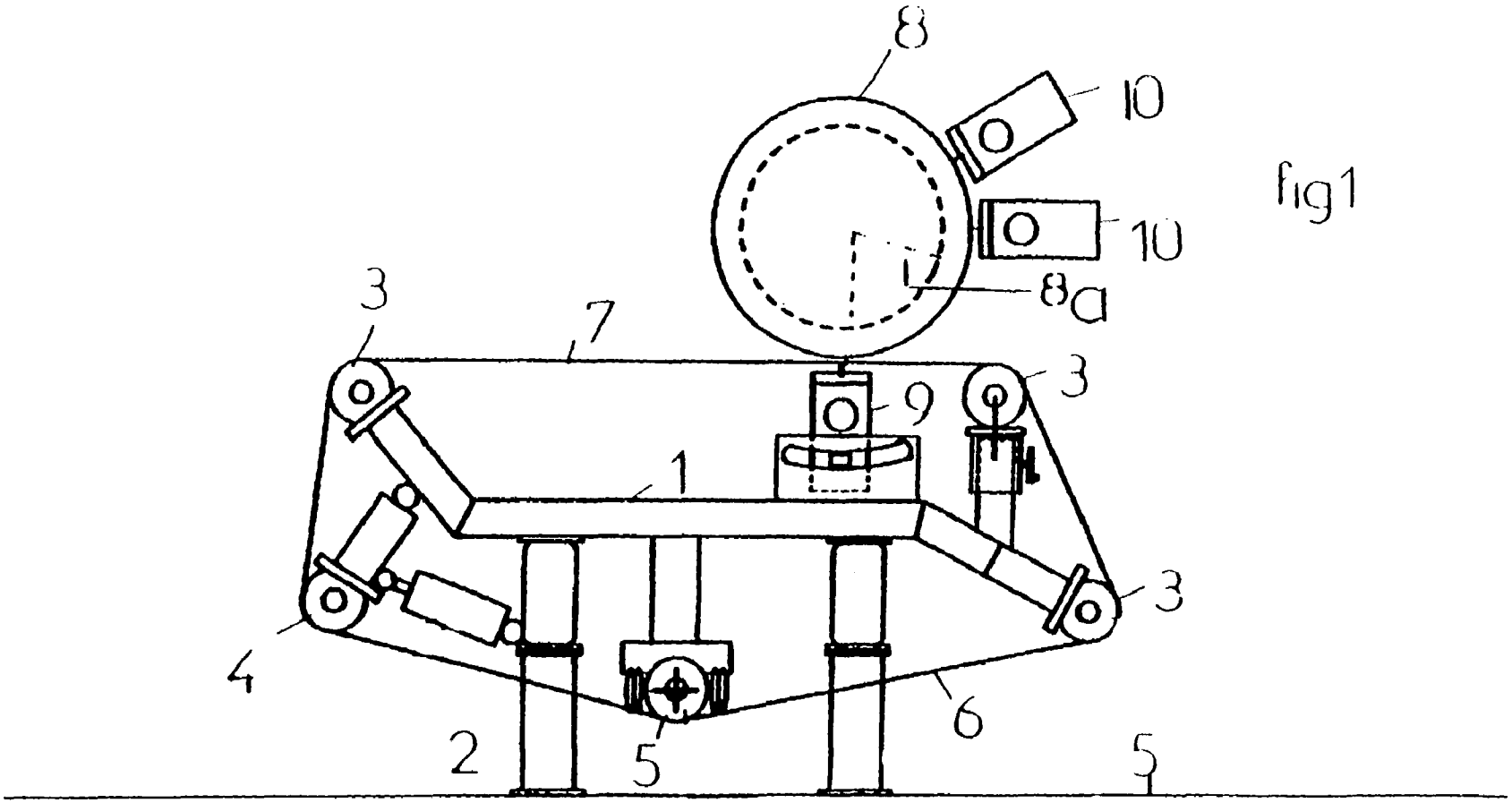

| | | | | |
|---|---|---|---|---|
| 6,979,186 | B2 | 12/2005 | Schmit et al. | |
| 2001/0005926 | A1* | 7/2001 | Noelle | 28/104 |
| 2003/0024092 | A1* | 2/2003 | Orlandi | 28/104 |
| 2005/0115036 | A1* | 6/2005 | Noelle | 28/104 |

FOREIGN PATENT DOCUMENTS

| | | |
|---|---|---|
| FR | 2304696 | 10/1976 |
| FR | 2821866 | 9/2002 |
| GB | 891143 | 3/1962 |
| WO | WO 02/34990 A1 | 5/2002 |

* cited by examiner

METHOD AND MACHINE FOR PRODUCING A NONWOVEN FABRIC WITH REDUCTION OF DISPLACEMENT SPEED OF THE COMPACTED MAT

The present invention relates to the methods and machines for the production of a nonwoven fabric consisting of fibers or of filaments composed of an organic material, in particular of natural, synthetic or artificial textile fibers or filaments. The fibers or filaments may be composed, in particular, of polypropylene, of polyester or of another plastic or their mixtures.

A method for producing a nonwoven fabric is already known, in which a mat of filaments or of fibers which is in displacement is compacted in the direction of thickness at a compacting station. Compacting is obtained by causing the mat to pass in displacement through the nip between two moveable elements which are displaced in the same direction. One of the moveable elements may be a conveyor or a cylinder and the other may likewise be a conveyor or a cylinder. Downstream of the compacting station, the compacted mat is consolidated into a consolidated mat at a consolidation station. Consolidation may be carried out by means of mechanical needling or by means of chemical or thermal binding. Hydraulic binding by means of water jets is preferably used.

The U.S. Pat. No. 4,632,685 describes a method for producing a nonwoven fabric, in which the two faces of the mat are displaced at first equal speeds in a pair of conveyors and then at second equal speeds, but different from the first speeds, in a second pair of conveyors. Transfer of the mat from one pair to the other presents problems of structure control which are all the more serious because the speed is high. The reduction in speed takes place at a point on the path of displacement of the mat other than where the mat is compacted.

The nonwoven fabrics obtained have a ratio of a property in the length direction, in particular of the tensile strength, to the same property in the breadth direction which is much greater than one. The length direction is defined by the direction in which the mat is displaced when it is delivered to the compacting station, while the breadth direction is the direction perpendicular to this direction in the plane of the mat. In order to make many industrial treatments easier and improve the characteristics of many products, it would desirable to reduce the ratio of a property of a nonwoven fabric in the length direction to this property in the breadth direction, whereas the methods for the production of webs, of sheets and of mats preferably orient the fibers or filaments in the length direction, while at the same time having a high displacement speed synonymous with high productivity.

The invention provides for this by means of a method for producing a nonwoven fabric, in which a mat of filaments or of fibers which is in displacement, said filaments or fibers being composed of an organic material, is compacted in the direction of thickness at a point on its path of displacement at a compacting station, and then the compacted mat is consolidated into a consolidated mat at a consolidation station downstream of the compacting station in the direction of displacement of the mat. According to the invention, the displacement speed of the mat is reduced at the very point on its path of displacement where it is compacted.

By the mat being simultaneously compacted and reduced in displacement speed at the same point, the fibers or filaments which, owing to the compacting, cannot be displaced perpendicularly to the plane of the mat are forced to reorient themselves in the breadth direction.

Good results were obtained by reducing the displacement speed, which is preferably between 10 and 600 m/min, preferably from 50 to 300 m/min, of the mat at the compacting point by 5 to 50%, preferably by 5 to 30%. Below 5%, the speed reduction is scarcely sufficient to reduce appreciably the ratio of the tensile strength in the length direction to the tensile strength in the breadth direction. Beyond 50%, the reorientation is so great that the uniformity of the mat is affected by it. Likewise, it is preferable to reduce the thickness of the mat at the compacting point from 99% to 30%, preferably from 99% to 50%, which gives the best results for the reduction in the ratio of the tensile strength in the length direction to the tensile strength in the breadth direction.

The property, the ratio of which is modified in the method according to the invention, is preferably the maximum tearing tensile strength, but it is also the tensile elongation or another tensile property. It was also found that the method according to the invention makes it possible to improve the delamination resistance of nonwoven fabrics.

According to an embodiment which much improves the method according to the invention, the mat is wetted at the compacting station or just downstream of this station. By means of this wetting, the deformation of the fibers of the mat is fixed, and the ratio between the property of the nonwoven fabric in the length direction and the property of the nonwoven fabric in the breadth direction is thus preserved, this being obtained at the compacting station, at the exit of the latter, whereas, without fixing by wetting, the fibers tend, after no longer being compacted, at least partially to resume their initial orientation. The term "just downstream" is understood, in particular, to mean that wetting takes place before the arrival of the mat at the consolidation station. For example, the mat may be wetted with the aid of a hydraulic injector arranged in such a way that the jets extend substantially over the entire width of the mat, jets, the pressure of which is between 1 and 50 bar, being delivered. Depending on the pressure used, this fixation may already have some consolidation effect, that is to say some effect of entanglement of the fibers. In some cases, wetting is carried out with the aid of a liquid other than pure water.

It is also possible, instead of or in addition to wetting the mat at the compacting station, to maintain it at the exit of the compacting station until it arrives at the consolidation station, or simply over part of the path between the two stations, for example by using a vacuum laid onto a cylinder or onto a conveyor.

The compacted mat is subsequently consolidated into a consolidated mat at the consolidation station, which, in the direction of displacement of the mat, is downstream of the compacting station and downstream of the point where, if appropriate, the wetting of the mat takes place. Consolidation may be carried out by any known means, in particular by mechanical needling with the aid of metal needles, by chemical binding, by thermal binding using thermofusible fibers and with the aid of impregnation means, such as a padding mangle or spraying or spraying with foam together with a binder. However, it is preferable by far to carry out consolidation by hydraulic binding by means of water jets, this being combined, moreover, if appropriate, with other binding means. Hydraulic binding may be carried out by means of water jets with a diameter of between 50 and 250 microns under pressures of between 10 and 1000 bar.

The mat is preferably a mat of filaments coming from a machine in hot-melt operation or a mat of fibers coming from a nonwoven card; it may also come from a machine operating by air, known as air-laid operation, or from a tenter-lapper.

The invention applies particularly to masses per unit area of 0 to 500 g/m$^2$, preferably of 20 to 300 g/m$^2$, of the mat.

The invention makes it possible, in particular, to manufacture filtration products, geotextiles or agrotextiles in civil engineering and building, in motor vehicles, furnishing and clothing, in medical applications, and in roof seals, acoustic and thermal insulation products, and dry or impregnated wiping products for domestic and hygienic use.

The invention is also aimed at a machine for producing a nonwoven fabric, comprising a first element for delivering a mat to means intended for compacting it in the direction of thickness, characterized in that said means are also means intended for reducing the displacement speed of the mat at the point where it is compacted by the compacting means. The first element is preferably a conveyor, but this may also be a cylinder fed by a conveyor.

The compacting means are implemented by the formation of a nipping point between the first element and another moveable element, and the reduction in displacement speed of the mat is implemented by imparting to the other moveable element a linear speed lower than that of the first element. The other moveable element may be a second conveyor or a second cylinder. Nipping preferably extends over the entire width of the mat and involves an entire generatrix of the nipping cylinder.

Preferably, the machine comprises means intended for wetting the mat when it is compacted or when it has just been compacted and before it arrives at consolidation means. Preferably, the consolidation means are arranged so as to consolidate the mat when it passes over the other moveable element, since consolidation is all the better, the lower the passage speed of the mat at the consolidation station is.

The invention is aimed, finally, at the use of a method or of a machine according to the invention for reducing the ratio of a property of a nonwoven fabric in the length direction to this property in the breadth direction and, more particularly, for reducing the ratio of the tearing tensile strength of a nonwoven fabric in the length direction to this tearing tensile strength in the breadth direction.

In the accompanying drawings, FIGS. 1 to 4 are side views of four machines according to the invention.

The machine illustrated in FIG. 1 comprises a conveyor comprising a stand 1 resting on the ground S by means of four feet 2. This stand carries three return rollers 3, a tensioning roller 4 and a roller 5 for guiding a water-permeable belt 6 of the conveyor. Above the upper strand 7 of the conveyor is mounted a cylinder 8 having a horizontal axis perpendicular to the direction of displacement of the strand 7, while a wetting injector 9 is mounted vertically in line with the cylinder 8 and below the strand 7. The distance between the strand 7 and the lowest point of the cylinder 8 is so small that, when a mat is conveyed and passes over the strand 7, it enters the nip between the strand 7 and the cylinder 8 and is compacted. The mat subsequently passes along the cylinder 8 in order to arrive in front of two injectors 10 for consolidation by means of water jets. The cylinder 8 is a hollow cylinder which rotates counterclockwise, while the mat which passes over the strand 7 goes from left to right in the drawing. The cylinder 8 comprises a quadrant 8*a* between 4 o'clock and 6 o'clock, which is subjected to a vacuum in such a way that mat is laid onto the cylinder 8 from the nip exit to the injectors 10.

Figure 2:
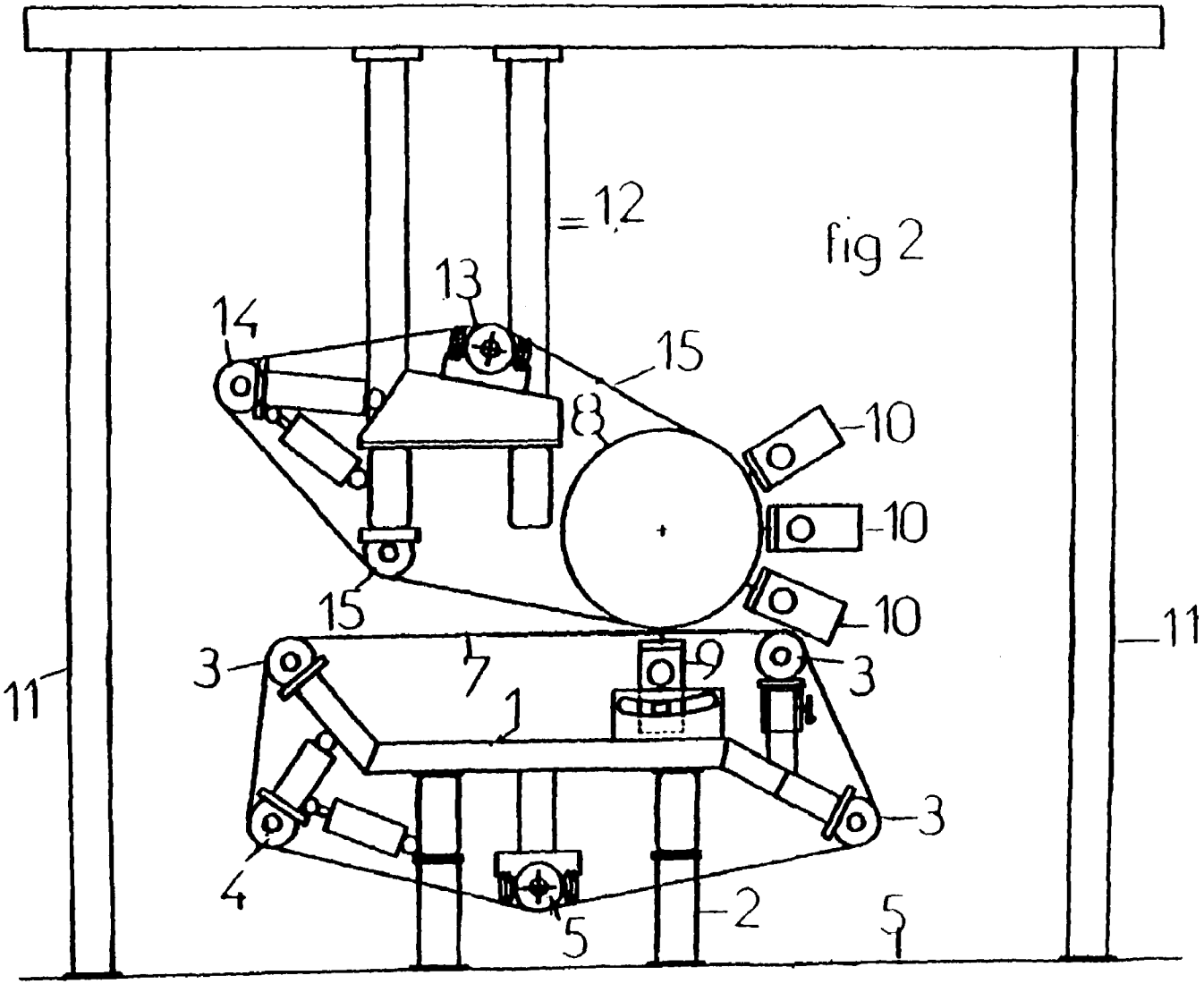

In FIG. 2, the machine illustrated is preferred when the thickness of the mat is greater than 50 mm. It comprises the same elements as the machine in FIG. 1, but, in addition, an additional conveyor carried by four feet 11 and brackets 12. The conveyor has a guide roller 13, a tensioning roller 14 and a return roller 15, and the water-permeable belt 15 of the conveyor passes around the cylinder 8 and into the nip between the cylinder 8 and the belt 7.

Figure 3:
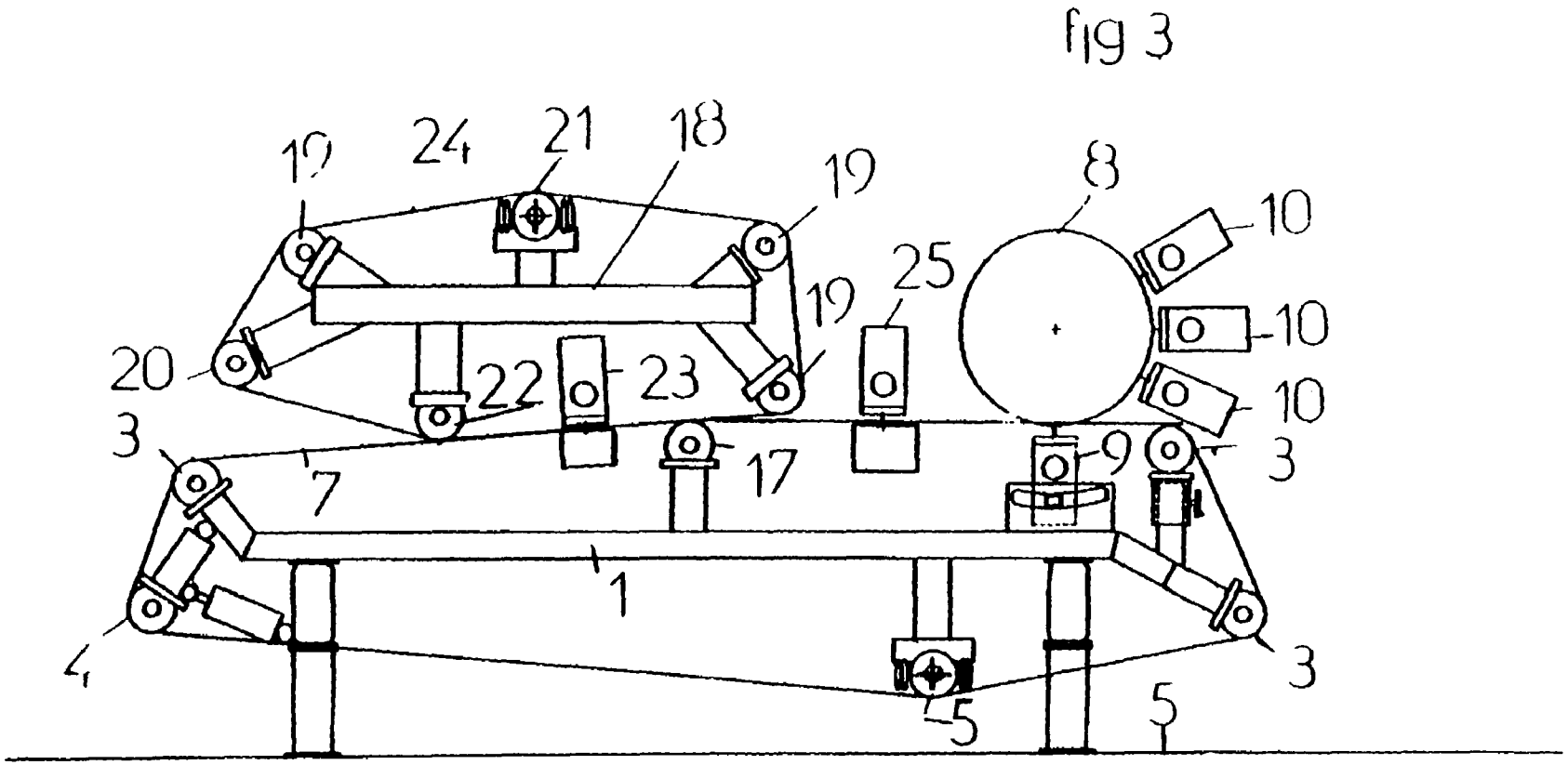

The machine illustrated in FIG. 3 comprises, like that of FIGS. 1 and 2, a first conveyor 1 to 7 which is identical to the conveyor of FIG. 1, except that it comprises a roller 17 supporting the upper strand 7 of the belt.

Above this strand 7 is arranged a conveyor 18 having return rollers 19, a tensioning roller 20 and a guide roller 21, the conveyor having, furthermore, a return roller 22 which is in contact with the upper strand 7 of the belt of the first conveyor and which is arranged on this strand, upstream of an injector 23 making it possible to wet a mat which arrives on the belt 7, going from left to right in the figure. The roller 17 is just downstream of the injector 23 and is arranged in such a way, with respect to the roller 22, that it keeps the strand 7 in close contact with the lower strand of the belt 24 which passes over the upper conveyor, at the same time rotating in the counterclockwise direction. The mat is thus compressed between the upper strand 7 and the lower strand of the belt 24, is wetted at the wetting point 23 and subsequently goes to a preliminary station 25 for consolidation by means of water jets, before being consolidated to a greater extent on the cylinder 8 by means of the water-jet devices 10.

Figure 4:
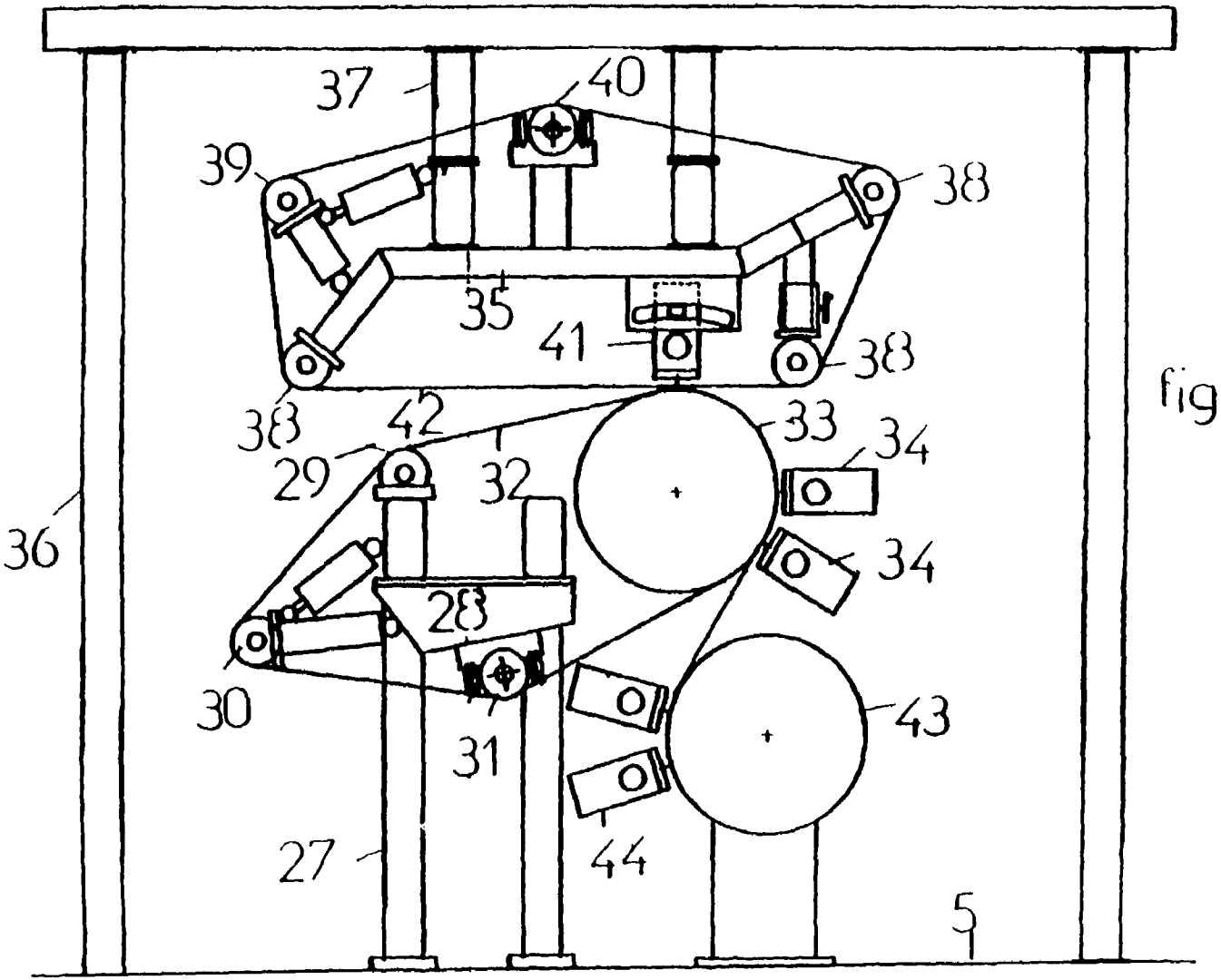

In FIG. 4, the ground has resting on it, by means of feet 27, a conveyor 28 having a return roller 29, a tensioning roller 30 and a roller 31 for guiding a water-permeable belt 32 which is wound onto a hollow cylinder 33, opposite which are mounted devices 34 for consolidation by means of water jets. Another conveyor 35, carried by supports 36 and brackets 37, comprises, on a stand, three return rollers 38, a tensioning roller 39 and a guide roller 40. The conveyor carries a device 41 for water projection which will serve for wetting. This water projection device is vertically above the vertex of the cylinder 33. The mat arrives on the upper strand of the belt 32 from left to right in the figure, passes between the cylinder 33 and the lower strand of the belt 42 of the upper conveyor, where it is compressed, while at the same time being moistened by the device 41, reemerges along the cylinder 33, in order to be consolidated by means of the consolidation devices 34, and then goes to a cylinder 43 cooperating with additional consolidation devices 44.

The following examples illustrate the invention.

In these examples, the following tests were conducted:

a) Strength and Elongation in the Length Direction and in the Breadth Direction:

A sample is conditioned for 24 hours, and the test is conducted at 23° C. and at a relative humidity of 50%. A dynamometer is used for the test, comprising a set of fixed jaws and a set of moveable jaws displaced at a constant speed. The jaws of the dynamometer have a useful width of 50 mm. The dynamometer is equipped with a recorder which makes it possible to trace the curve of the tensile force as a function of the elongation. 5 samples of 50 mm, plus or minus 0.5 mm of width, and with a length of 250 mm are cut in the length direction and in the breadth direction of the nonwoven fabric. The samples are tested one by one at a constant tensile speed of 100 mm per minute and with an initial jaw spacing of 200 mm. The dynamometer records the curve of the tensile force in Newtons as a function of elongation. The maximum is determined from this.

b) Mass per Square Meter:

A sample is conditioned for 24 hours, and the test is conducted at 23° C. and at a relative humidity of 50%.

At least three samples with an area of at least 50,000 mm$^2$ are cut by means of a cutting appliance called a guillotine.

Each sample is weighed on a laboratory balance having an accuracy of 0.1% of the mass of the weighed samples.

EXAMPLE 1 (COMPARATIVE)

A mat of approximately 50 g/m$^2$ composed of 100% polyester fibers of 1.7 dtex and with a length of 38 mm is produced at a speed of 50 m/min by means of a card of the nonwoven fabric card type.

This mat is delivered continuously to a transport and compacting conveyor of a water-jet binding installation according to FIG. 1. The transport conveyor is a polyester cloth with a permeability of 800 CFM. The transport conveyor has a linear speed of 50 m/min.

The transport conveyor is in contact with the cylinder over a length of 10 nm. The speed of the cylinder is synchronized with the speed of the transport conveyor to a linear speed of 50 m/min. The fiber mat is compacted between the transport conveyor and the binding cylinder covered with a microperforated blanket, the holes being arranged randomly, as described in French patent 2 734 285. Immediately after compacting, the web is wetted and slightly consolidated by means of a hydraulic injector projecting water jets with a diameter of 140 microns at a speed of 54 m/s under a pressure of 15 bar. The jets are spaced from one another at a distance of 0.8 mm in two rows.

The web, thus compacted and wetted and slightly consolidated, is then subjected to the action of two successive hydraulic injectors projecting water jets with a diameter of 120 microns at increasing speeds of 100 m/s and 133 m/s, the jets being spaced from one another at 1.2 mm in two rows.

The nonwoven fabric thus obtained is subsequently transferred onto a suction belt connected to a vacuum generator and is then dried at a temperature of 110° C. in a flow-type air furnace.

A nonwoven fabric weighting approximately 50 g/m$^2$ is obtained. The nonwoven fabric has a regular and uniform appearance.

EXAMPLE 2

The conditions of example 1 are repeated. For this test, the speed of the cylinder is reduced by 10% in relation to the speed of the conveyor. That is to say, the speed of the transport and compacting conveyor is still 50 m/min, and the speed of the cylinder is 45 m/min.

The nonwoven fabric has a regular appearance.

EXAMPLE 3

The conditions of example 1 are repeated. For this test, the speed of the cylinder is reduced by 20% in relation to the speed of the conveyor. That is to say, the speed of the transport and compacting conveyor is still 50 m/min, and the speed of the cylinder is 40 m/min.

The nonwoven fabric is regular.

EXAMPLE 4

The conditions of example 1 are repeated. For this test, the speed of the cylinder is reduced by 25% in relation to the speed of the conveyor. That is to say, the speed of the transport and compacting conveyor is still 50 m/min, and the speed of the cylinder is 40 m/min.

The nonwoven fabric is irregular and has fiber wavelets in the breadth direction.

EXAMPLE 5

The conditions of example 1 are repeated. For this test, the transport conveyor is no longer in contact with the cylinder. It is now tangent to the latter and at a distance from the cylinder of approximately 1 mm. This new setting is obtained by lowering the return roller of the conveyor immediately downstream of the tangent point of the conveyor with respect to the cylinder. The speed conditions are identical to example 2, in which the speed of the conveyor is 50 m/min and the speed of the cylinder is 45 m/min.

The nonwoven fabric is regular.

EXAMPLE 6

The conditions of example 5 are repeated. For this test, the speed of the cylinder is reduced by 20% in relation to the speed of the conveyor. That is to say, the speed of the transport and compacting conveyor is still 50 m/min, and the speed of the cylinder is 40 m/min.

The nonwoven fabric is regular.

EXAMPLE 7

The conditions of example 5 are repeated. For this test, the speed of the cylinder is reduced by 30% in relation to the speed of the conveyor. That is to say, the speed of the transport and compacting conveyor is still 50 m/min, and the speed of the cylinder is 35 m/min.

The nonwoven fabric is regular.

EXAMPLE 8

The conditions of example 5 are repeated. For this test, the speed of the cylinder is reduced by 40% in relation to the speed of the conveyor. That is to say, the speed of the transport and compacting conveyor is still 50 m/min, and the speed of the cylinder is 30 m/min.

The nonwoven fabric has surface irregularities, wavelets oriented in the breadth direction of the mat and irregularity in its opacity.

EXAMPLE 9 (COMPARATIVE)

A mat of approximately 90 g/m$^2$, composed of 65% viscose fibers of 1.7 dtex and with a length of 40 mm and of 35% polyester fibers of 1.7 dtex and with a length of 38 mm, is produced at a speed of 25 m/min by means of a card of the nonwoven fabric card type.

This mat is delivered continuously to a transport and compacting conveyor of a water-jet binding installation according to FIG. 2. The installation differs from that of FIG. 1 in the addition of an upper conveyor winding around the cylinder.

The transport conveyor is a polyester cloth with a permeability of approximately 800 CFM. The transport conveyor has a linear speed of 30 m/min. The upper conveyor winding around the cylinder is also a polyester cloth with a permeability of approximately 500 CFM.

The transport conveyor is tangent to the second conveyor and to the cylinder and is at a distance from the second conveyor of approximately 1.5 mm at the point of convergence.

The speed of the upper conveyor and of the cylinder is synchronized with the speed of the transport conveyor to a speed of 25 m/min. The fiber mat is compacted progressively between the two conveyors, and, immediately after compacting, the web is wetted and slightly consolidated by means of a hydraulic injector projecting water jets with a diameter of 140 microns at a speed of 63 m/s, under a pressure of 20 bar. The jets are spaced from one another at a distance of 0.8 mm in two rows.

The web, thus compacted and wetted and slightly consolidated, is then subjected to the action of two successive hydraulic injectors projecting water jets with a diameter of 120 microns at increasing speeds of 125 m/s and 160 m/s, the jets being spaced from one another by 1.2 mm in two rows.

The nonwoven fabric thus obtained is subsequently transferred onto a suction belt connected to a vacuum generator and is then dried at a temperature of 110° C. in a flow-type air furnace.

The nonwoven fabric thus obtained is regular and uniform.

EXAMPLE 10

The conditions of example 9 are repeated. For this test, the speed of the upper conveyor and of the cylinder is reduced by 20% in relation to the speed of the conveyor. That is to say, the speed of the transport and compacting conveyor is still 25 m/min, and the speed of the cylinder is 20 m/min.

The nonwoven fabric is regular.

EXAMPLE 11

The conditions of example 9 are repeated. For this test, the speed of the upper conveyor and of the cylinder is reduced by 30% in relation to the speed of the conveyor. That is to say, the speed of the transport and compacting conveyor is still 25 m/min, and the speed of the cylinder is 17.5 m/min.

The nonwoven fabric is regular.

EXAMPLE 12

The conditions of example 9 are repeated. For this test, the speed of the upper conveyor and of the cylinder is reduced by 40% in relation to the speed of the conveyor. That is to say, the speed of the transport and compacting conveyor is still 25 m/min, and the speed of the cylinder is 17.5 m/min.

The nonwoven fabric is slightly irregular with a variation in its opacity which suggests a slipping of fibers in the transverse direction.

EXAMPLE 13 (COMPARATIVE)

A mat of approximately 60 g/m$^2$, composed of 80% polyester fibers of 1.7 dtex and with a length of 38 mm and of 20% polyester/polyethylene bicomponent fibers, as they are referred to, of 3 dtex and with a length of 38 mm, is produced at a speed of 30 m/min by means of a card of the nonwoven fabric card type.

This mat is delivered continuously to a transport and compacting conveyor XX of a water-jet binding installation according to FIG. 1. The transport conveyor is a polyester cloth. The transport conveyor has a linear speed of 30 m/min.

The transport conveyor is tangent to a cylinder. The speed of the cylinder is synchronized with the speed of the transport conveyor to a speed of 30 m/min. The fiber mat is compacted between the transport conveyor and the binding cylinder covered with a microperforated blanket, the holes being arranged randomly, as described in French patent 2 734 285. Immediately after compacting, the web is wetted and slightly consolidated by means of a hydraulic injector projecting water jets with a diameter of 140 microns at a pressure of 70 bar. The jets are spaced from one another by a distance of 1.2 mm in two rows.

The web, thus compacted and wetted and slightly consolidated, is subsequently transferred onto a suction belt connected to a vacuum generator and is then dried at a temperature of 130° C. in a flow-type air furnace.

A nonwoven fabric weighing approximately 60 g/m$^2$ is obtained. The nonwoven fabric has a regular and uniform appearance and it is bulky.

EXAMPLE 14

The conditions of example 9 are repeated. For this test, the speed of the upper conveyor and of the cylinder is reduced by 30% in relation to the speed of the conveyor. That is to say, the speed of the transport and compacting conveyor is still 30 m/min, and the speed of the cylinder is 21 m/min.

The nonwoven fabric is regular and bulky.

The laboratory tests for measuring the mass per unit area and the strength in the length direction and in the breadth direction are conducted according to the ERT standards of the EDANA.

The following table summarizes the results of strength in the length direction and breadth direction and of the ratio of the length direction to the breadth direction which were obtained for each example.

| Example | Mass per unit area g/m$^2$ | Strength in length direction N/50 mm | Strength in breadth direction N/50 mm | Ratio of length direction to breadth direction |
|---|---|---|---|---|
| 1 | 50 | 136 | 38 | 3.6 |
| 2 | 52 | 139 | 41 | 3.4 |
| 3 | 55 | 145 | 44 | 3.3 |
| 4 | 58 | 155 | 49 | 3.2 |
| 5 | 55 | 149 | 45 | 3.3 |
| 6 | 59 | 148 | 50 | 3.0 |
| 7 | 63 | 158 | 61 | 2.6 |
| 8 | 65 | 164 | 66 | 2.5 |
| 9 | 90 | 98 | 32 | 3.1 |
| 10 | 105 | 105 | 41 | 2.6 |
| 11 | 114 | 110 | 48 | 2.3 |
| 12 | 120 | 113 | 52 | 2.2 |
| 13 | 65 | 57 | 18 | 3.2 |
| 14 | 81 | 64 | 28 | 2.3 |

The invention claimed is:

1. A method for producing a nonwoven fabric, in which a mat of filaments or of fibers which is in displacement, said filaments or fibers being composed of an organic material, is compacted in the direction of thickness at a point on its path of displacement, and the compacted mat is then consolidated into a consolidated mat, downstream at a consolidation station, characterized in that the displacement speed of the mat is reduced at the very point on its path of displacement where it is compacted and the mat is maintained by applying a vacuum to it between the point where it is compacted and the consolidation station.

2. The method as claimed in claim 1, characterized in that the displacement speed of the mat is reduced by 5 to 50%.

3. The method as claimed in claim 1, characterized in that the thickness of the mat at compacting is reduced from 99% to 30%.

4. The method as claimed in claim 1, characterized in that the mat is wetted at compacting or just downstream of compacting.

5. The method as claimed in claim 1, characterized in that the mat is consolidated by causing it to pass through the consolidation station at the reduced speed.

6. The method as claimed in claim 1, characterized in that the mat is consolidated by hydraulic entanglement, by thermal binding, by chemical binding and/or by mechanical needling.

7. The method as claimed in claim 1, characterized in that the mat is a mat of filaments coming from a machine in hot-melt operation or a mat of fibers coming from a card for nonwoven fabrics or from a machine operating by air, known as air-laid operation.

8. The method as claimed in claim 1, wherein the step of reducing the displacement speed includes reducing the displacement speed in an amount sufficient to reduce the ratio of a property of the nonwoven fabric in the length direction and the breadth direction.

9. A machine for producing a nonwoven fabric, comprising a first element for delivering a mat to means for compacting it in the direction of thickness, characterized in that said means are also means for reducing the displacement speed of the mat at the point where it is compacted, further including consolidating means for consolidating the mat, the consolidating means being arranged downstream of the compacting means in the direction of displacement of the mat, and vacuum means for maintaining the mat between the compacting means and the consolidation means by a vacuum.

10. The machine as claimed in claim 9, characterized in that the compacting and speed reduction means are implemented by the formation of a nipping point between the first element and another moveable element having a linear speed lower than that of the first element.

11. The machine as claimed in claim 10, characterized in that the other moveable element is a conveyor or a cylinder.

12. The machine as claimed in claim 9, characterized by means intended for wetting the mat when it is being compacted or when it has just been compacted.

13. The machine as claimed in claim 9, characterized in that the consolidation means are arranged so as to consolidate the mat when it passes over another moveable element.

14. A method for producing a nonwoven fabric including a mat of organic filaments or organic fibers comprising the steps of providing a first movable element operable at a first linear speed for transporting the mat along a displacement path and another movable element operable at another linear speed for further transporting the mat along the displacement path, forming a nipping point between the first movable element and the another movable element, the another movable element being arranged above the first movable element, transporting the mat at a displacement speed along the displacement path and through the nipping point, compacting the mat in the direction of thickness in the nipping point and reducing the displacement speed of the mat in the nipping point by operating the another movable element at a linear speed that is from about 5% to about 50% lower than that of the first movable element, consolidating the compacted mat at a downstream consolidation station to form a consolidated mat, and wetting the mat at compacting or just downstream of compacting.

* * * * *